US008572809B2

(12) United States Patent
Binder et al.

(10) Patent No.: US 8,572,809 B2
(45) Date of Patent: Nov. 5, 2013

(54) APPARATUS FOR SPRING-ASSISTED PIVOTING OF A LIFTGATE OR DOOR, AND METHOD FOR PRODUCING SUCH APPARATUS

(75) Inventors: Franz Binder, Lenting (DE); Jürgen Sendtner, Denkendorf-Zandt (DE); Knut Bartsch, Ebersberg (DE); Manfred Schindler, Markt Schwaben (DE); Franz Sinseder, Dorfen (DE)

(73) Assignee: Audi AG, Ingolstadt (DE)

( * ) Notice: Subject to any disclaimer, the term of this patent is extended or adjusted under 35 U.S.C. 154(b) by 304 days.

(21) Appl. No.: 13/161,038

(22) Filed: Jun. 15, 2011

(65) Prior Publication Data

US 2011/0308166 A1 Dec. 22, 2011

(30) Foreign Application Priority Data

Jun. 16, 2010 (DE) ..... 10 2010 023 970

(51) Int. Cl.
*E05F 1/08* (2006.01)

(52) U.S. Cl.
USPC ..... 16/308; 188/277

(58) Field of Classification Search
USPC ..... 267/277, 273, 285, 154; 16/308, 382, 16/390, 306, 291, 295, 305, 312
See application file for complete search history.

(56) References Cited

U.S. PATENT DOCUMENTS

| | | | | | |
|---|---|---|---|---|---|
| 2,688,764 | A | | 9/1954 | Squire | |
| 2,986,770 | A | * | 6/1961 | Hammond | 16/308 |
| 4,285,098 | A | * | 8/1981 | Hicks et al. | 16/308 |
| 4,621,391 | A | * | 11/1986 | Leonard | 16/299 |
| 5,613,308 | A | * | 3/1997 | Little | 37/445 |
| 5,791,017 | A | * | 8/1998 | Kluting | 16/334 |

FOREIGN PATENT DOCUMENTS

WO WO 2010/025817 3/2010

* cited by examiner

*Primary Examiner* — Melanie Torres Williams
(74) *Attorney, Agent, or Firm* — Henry M. Feiereisen LLC

(57) ABSTRACT

An apparatus for spring-assisted pivoting a liftgate or door against gravity between a closed position and an open position includes a torsion bar spring system with springs arranged in parallel in a meander pattern and connected with one another in fixed rotative engagement. An outer bearing-torsion bar spring and another outer lever-torsion bar spring are each supported in a support bracket of a tracker. The lever-torsion bar spring is connected in fixed rotative engagement with a length-adjustable lever guided in a control cam of the tracker. A coupling rod configured for translatory movement engages with the length-adjustable lever for rotating a hinged lever associated with the liftgate or door. An adjusting device is connected with the bearing-torsion bar spring in fixed rotative engagement and can be variably locked relative to the support bracket. A method for producing such apparatus is also disclosed.

10 Claims, 4 Drawing Sheets

APPARATUS FOR SPRING-ASSISTED PIVOTING OF A LIFTGATE OR DOOR, AND METHOD FOR PRODUCING SUCH APPARATUS

CROSS-REFERENCES TO RELATED APPLICATIONS

This application claims the priority of German Patent Application, Serial No. 10 2010 023 970.4, filed Jun. 16, 2010, pursuant to 35 U.S.C. 119(a)-(d), the content of which is incorporated herein by reference in its entirety as if fully set forth herein.

BACKGROUND OF THE INVENTION

The present invention relates to an apparatus for spring-assisted pivoting of a liftgate or door, and method for producing such apparatus.

The following discussion of related art is provided to assist the reader in understanding the advantages of the invention, and is not to be construed as an admission that this related art is prior art to this invention.

An apparatus for spring-assisted pivoting of a liftgate or door, in particular supported by a torsion bar spring system, against gravity between a closed position and an open position with an adjusting device for (re-)adjustment of the torque to be supplied by the torsion bar spring system, and a method for producing such an apparatus.

Apparatuses of the aforedescribed type are used in the automobile industry for reducing the operating forces when a liftgate or a door is pivoted against gravity between a closed position and an open position and, if necessary, for self-locking of the liftgate or door in one or more open positions.

Disadvantageously, fine adjustment of the pretension of the torsion bar spring system and hence also of the counter torque supplied by the torsion bar spring system is very difficult during the assembly of the device and in particular after the device is installed in a vehicle. As a result, possible tolerances of the components, for example of the liftgate or the torsion bar spring system, or a relaxation of the torsion bar springs can only be insufficiently compensated.

It would therefore be desirable and advantageous to provide an apparatus for spring-assisted pivoting of a liftgate or door, with which the pretension of the torsion bar system can (subsequently) be easily and cost-effectively adjusted, and a method for producing such an apparatus.

SUMMARY OF THE INVENTION

According to one aspect of the invention, an apparatus for spring-assisted pivoting of a liftgate or door against gravity between a closed position and an open position includes a tracker comprising a support bracket and a control cam, a length-adjustable lever guided in the control cam of the tracker, and a coupling rod configured for translatory movement and operatively connected to the length-adjustable lever, wherein the coupling rod is configured to rotationally move a hinged lever associated with the liftgate or door. The apparatus further includes a torsion bar spring system having torsion bar springs arranged in parallel in a meander pattern and connected with one another in fixed rotative engagement, wherein a first outer torsion bar spring of the torsion bar spring system is constructed as a bearing-torsion bar spring and a second outer torsion bar spring of the torsion bar spring system is constructed as a lever-torsion bar spring which is connected in fixed rotative engagement with the length-adjustable lever, with both the first and the second outer torsion bar spring being supported in the support bracket of the tracker. The apparatus further includes an adjusting device which is connected in fixed rotative engagement with the bearing-torsion bar spring and can be variably locked relative to the support bracket.

By connecting an adjusting device in fixed rotative engagement to the bearing-torsion bar spring, the pretension of the overall torsion bar spring system produced by the torsion of the individual torsion bar springs can be adapted. When a nominal value of the pretension is reached, the adjusting device may be permanently or temporarily locked in the corresponding position relative to the support bracket. The pretension can still be adapted as needed with a temporary lock. The adjusting device allows adaptation of the supplied torque from the torsion bar spring system to the tracker connected via the lever-torsion bar spring. The tracker includes a gear arrangement similar to a swinging transmission which translate the linear torque from the torsion bar spring system to a curved, preferably bent, torque curve at the hinged lever. The weight-induced torque of the liftgate or door varies along the pivoting path due to the changing position of the center of gravity. The weight-induced torque increases from the closed position until reaching a maximum weight-related torque in an essentially horizontal position of the liftgate or door. The weight-induced torque decreases again upon further pivoting towards the open position. The linear torque curve of the torsion bar spring system can be adapted to a desirable torque curve for supporting the liftgate or door with a specific design of the control cam, allowing the liftgate or door to, for example, self-lock in any open position or generating different acceleration phases along the pivoting path. The change in the length of the lever arm of the length-adjustable lever is accomplished by guiding one side of the lever arm in the control cam, for example with a guide element embodied as a slider. The physical length of the length-adjustable lever is hereby not changed; instead, only the distance between the rotation axis defined by the lever-torsion bar spring and the guide body guided in the control cam, because the coupling rod to the hinged lever also engages with the guide body. The mechanically effective length of the lever arm is therefore essentially adjustable by moving, for example, the guide body in a slot or allowing the guide body to slide along the length-adjustable lever. The coupling rod engages on the hinged lever such that the longitudinal axis of the coupling rod does not extend through the rotation axis of the hinged lever, so that the translatory push or pull movement of the coupling rod results in a rotation of the hinged lever about its rotation axis. For supporting a tailgate in a vehicle, two devices of this type are preferably arranged in the roof region of the vehicle so that a respective device engages with a corresponding upper marginal region of the tailgate. The device is also suitable for operating a door arranged on the side of a vehicle, preferably a scissor-style door, which can be pivoted about a rotation axis that extends substantially horizontally or transversely to the vehicle.

According to an advantageous feature of the present invention, the adjusting device may have an adjusting lever which engages with one of its ends at least temporarily in fixed rotative engagement on the bearing-torsion bar spring. The bearing-torsion bar spring can be adjusted with the adjusting lever by applying a particularly small force. The adjusting lever can also be easily locked with respect to the support bracket. The adjusting lever needs to be connected with the bearing-torsion bar spring in fixed rotative engagement only during the adjustment process and can be eliminated after the pretension has been adjusted and the bearing-torsion bar spring has been locked in the corresponding position.

According to another advantageous feature of the present invention, the adjusting lever may have on its other end an adjusting screw which is supported on the support bracket. Arranging a thread and an installed screw on the other end of the adjusting lever facilitates subsequent adjustment of the torsion bar spring system by supporting the screw head on the support bracket. A V-shaped wedge may also be arranged between the screw head and the support bracket, which forms an improved contact surface at different rotation angle of the adjusting lever.

According to another advantageous feature of the present invention, the adjusting lever may have on its other end a rotatable tensioning bracket, wherein the angled part of the tensioning bracket engages below the support bracket at a variable distance. If a tensioning bracket engages on the other end of the adjusting lever for rotation, then the different rotation angles of the adjusting lever can be compensated by guiding the tensioning bracket substantially perpendicular with respect to the bottom side of the support bracket. The angled portion of the tensioning bracket engages under the support bracket, wherein the distance between the support bracket and the angled part can be varied by suitable measures, for example with an adjusting screw which is supported on the bottom side of the support bracket. The distance between the angled part of the tensioning bracket and the bottom side of the support bracket and thus the rotation angle of the adjusting lever can thereby be permanently and easily adapted.

Because the adjusting screws of the adjusting device are supported on the bottom side of the support bracket, the torsion bar spring system can also be adjusted after installation in a roof section of the vehicle from the vehicle interior. This provides optimal flexibility regarding manufacturing and installation tolerances, as well as different liftgate or door designs.

According to another aspect of the invention, a method for producing an apparatus for spring-assisted pivoting of a liftgate or door against gravity between a closed position and an open position, includes the steps of connecting torsion bar springs of a torsion bar spring system with coupling elements in fixed rotative engagement, twisting inner torsion bars of a torsion bar spring system until a first partial torque is attained when the torsion bar spring system is arranged in a plane, inserting an outer lever-torsion rod spring and an outer bearing-torsion bar spring of the torsion bar spring system in corresponding bearing seats of a support bracket, connecting the lever-torsion rod spring with a length-adjustable lever in fixed rotative engagement, pivoting the length-adjustable lever until a second partial torque of the torsion bar spring system is attained, and temporarily locking the length-adjustable lever with respect to the support bracket, and connecting the bearing-torsion rod spring with an adjusting device, pivoting the adjusting device until a desired total torque of the torsion bar spring system is attained, and locking the adjusting device or the bearing-torsion bar spring.

By using the aforedescribed method for producing an apparatus for spring-assisted pivoting of a liftgate or door, manufacturing tolerances can be particularly easily compensated. In a first step, the torsion bar spring system is assembled, whereby initially only the inner torsion bar springs are twisted to a first partial torque and thus pretensioned. The first partial torque results preferably from the contribution of the number of installed torsion bar springs less two, i.e. the inner torsion bar springs, to the desired total torque. The torsion bar spring system may be assembled in a plane, wherein a first torsion bar spring is twisted and subsequently connected by way of the coupling element to a subsequent torsion bar spring which is then also twisted. This process is repeated until all torsion bar springs are connected with one another and the inner torsion bar springs are twisted. If a structure of the torsion bar spring system is preferred where the torsion bar springs need not be twisted when the torsion bar spring system is assembled, then the torsion bar springs should be arranged with a defined angle relative to one another, preferably in form of a circle. The torsion bar spring system obtained in this way is automatically tensioned to the desired first partial torque during the expansion into a plane.

In a second step, the torsion bar spring system is mounted on the tracker by inserting the outer torsion bar springs in the openings provided on the support bracket which form bearing seats for the torsion bar springs. The torsion bar spring system can then no longer relax and remains pretensioned to the first partial torque.

In a third step, the lever-torsion bar spring is connected in fixed rotative engagement with the length-adjustable lever and by rotating the lever pretensioned to a second partial torque. The second partial torque results preferably from the contribution of the number of installed torsion bar springs less one, i.e., the inner torsion bar springs and the lever-torsion bar springs, to the desired total torque. The length-adjustable lever should be applied to the lever-torsion bar spring such that the lever is in the desired position with respect to the control cam, preferably in the center of the control cam, after reaching a rotation angle required for attaining the second partial moment.

In a fourth step, the bearing-torsion bar spring is connected in fixed rotative engagement with the adjusting device and the torsion bar spring system is pretensioned to the desired total torque by rotating the adjusting device. The desired total torque can be measured on the coupling rod, for example with a load cell, and corresponds to the required counter-torque for preferably substantially compensating the weight-induced torque of the liftgate or door.

The remaining components of the device, for example the coupling element, the hinged lever, etc., are installed in additional steps.

According to another advantageous feature of the present invention, the torsion bar springs may be formfittingly or materially connected with the coupling elements, wherein the coupling elements positioned opposite the tracker are pivotally supported in a bearing web. The positive connection of the torque springs with the coupling elements allows a flexible and simple structure of the torsion bar spring system, whereas the material connection, for example by welding, allows a particularly compact structure of the torsion bar spring system. To eliminate undesirable vibrations and pivoting movements of the free end of the torsion bar spring system facing the tracker, the coupling elements are rotatably supported in a bearing web.

According to another advantageous feature of the present invention, the coupling elements may have an elongated shape and are oriented horizontally at half the opening angle between the closed position and the open position of the liftgate or door. The coupling elements then rotate together in both directions, starting from the center position of the liftgate or door, which equalizes the load on the torsion bar springs and makes better use of the installation space in the vehicle.

According to another advantageous feature of the present invention, the length-adjustable lever may be formfittingly connected with the lever-torsion bar spring and can be temporarily locked with a safety pin with respect to the support bracket. If the length-adjustable lever is locked with a safety pin with respect to the support bracket, then the device can already be pretensioned before installation in a vehicle. If the apparatus is loaded by the torque from the liftgate or door, then the safety pin can be pulled out and the torsion bar spring system is released.

According to another advantageous feature of the present invention, the adjusting device may be materially connected with the support bracket. An apparatus according to the invention can be particularly easily produced by attaching the adjusting device on the support bracket after the adjustment process materially, in particular by welding. The bearing-torsion bar spring can for this purpose be provided with the element, for example a hexagon nut, configured to engage with a wrench having a torsion sensor and operated by applying an external force, wherein the wrench rotates the bearing-torsion bar spring until the desired total torque of the rotation bar spring system is reached. The hexagon nut can be welded to the support bracket after adjustment.

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
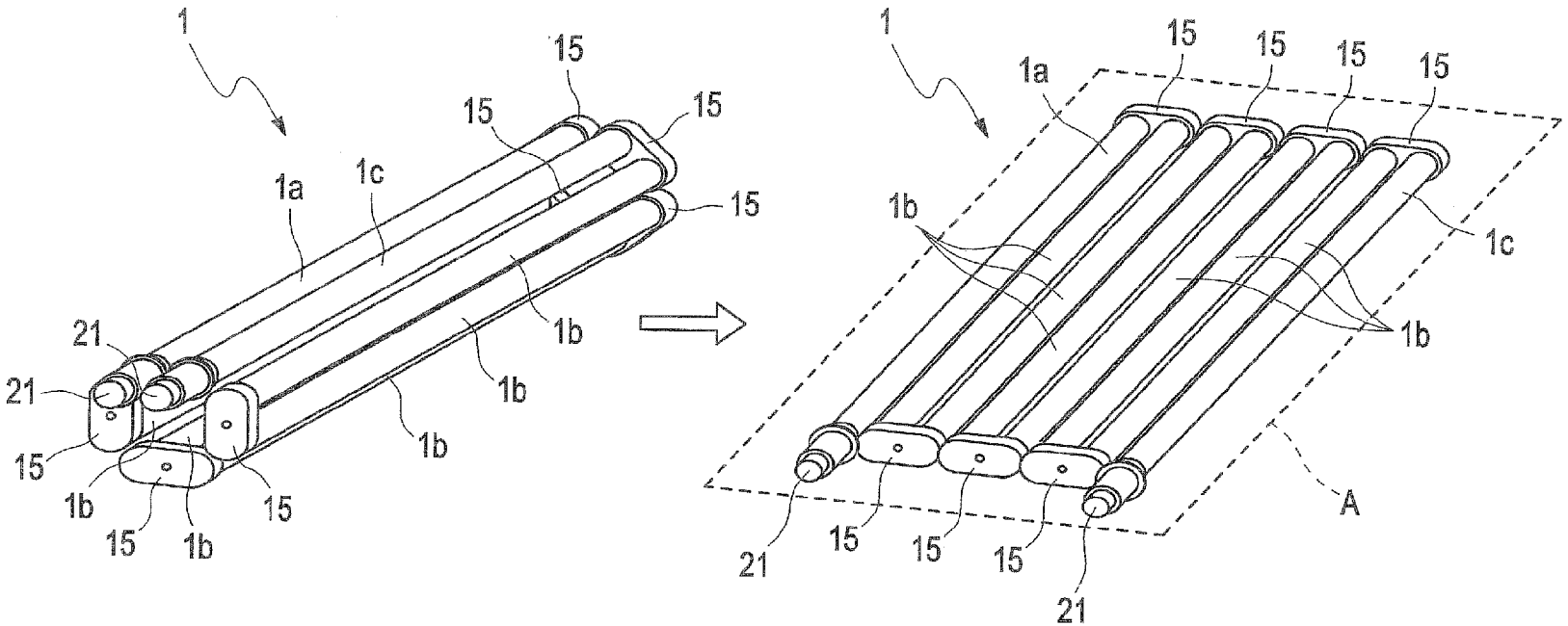
FIG. 1 shows two different states of the torsion bar spring system.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a torsion bar spring system 1, which includes several torsion rod springs 1*a*, 1*b* and 1*c* arranged in parallel in a meander pattern and connected with one another in fixed rotative engagement by way of a coupling elements 15, for an apparatus for spring-assisted pivoting of a liftgate or door, can be constructed in at least two geometric configurations. The illustration on the left shows a torsion bar spring system 1 with a mutual circular arrangement of the individual torsion rod springs 1*a*, 1*b* and 1*c*, wherein the individual torsion rod springs 1*a*, 1*b* and 1*c* are in an untwisted relaxed state. If the torsion bar spring system 1 is stretched in a plane A by applying a force, as illustrated in the illustration on the right, then the inner torsion bar springs 1*b* are twisted relative to one another due to the fixed rotative connection and are thereafter under pretension. The outer torsion bar springs, in the present example the lever-torsion bar spring 1*a* and the bearing-torsion bar spring 1*c*, are in this configuration not twisted and hence relaxed. These springs are also longer than the inner torsion bar springs 1*b*, so that they can be inserted with their ends in a tracker 3 illustrated in FIGS. 2-4. Preferably, all torsion bar springs 1*a*, 1*b* and 1*c* are constructed as identical parts, wherein the outer torsion bar springs 1*a* and 1*c* are extended by applying extension pieces 21. The coupling elements 15 can be placed on to the ends of the torsion bar springs 1*a*, 1*b* and 1*c* with an interference fit or materially connected, for example by welding. Such torsion bar spring system 1 can be constructed either in the circular or in the planar configuration. When constructing a torsion bar spring system 1 with the circular configuration, the torsion bar springs 1*a*, 1*b* and 1*c* can remain untwisted during assembly. The pretension of the entire torsion bar spring system 1 is attained later by stretching the circular arrangement on the plane A. When constructing a torsion bar spring system 1 in the planar configuration, each into torsion bar spring 1*b* must be individually pre-twisted, before the next torsion rod spring can be attached with a coupling element 15. Advantageously, suitable means may be used to directly engage with the coupling elements 15 and generate torsion of the corresponding torsion bar spring 1*b* by rotating the same.

Figure 2:
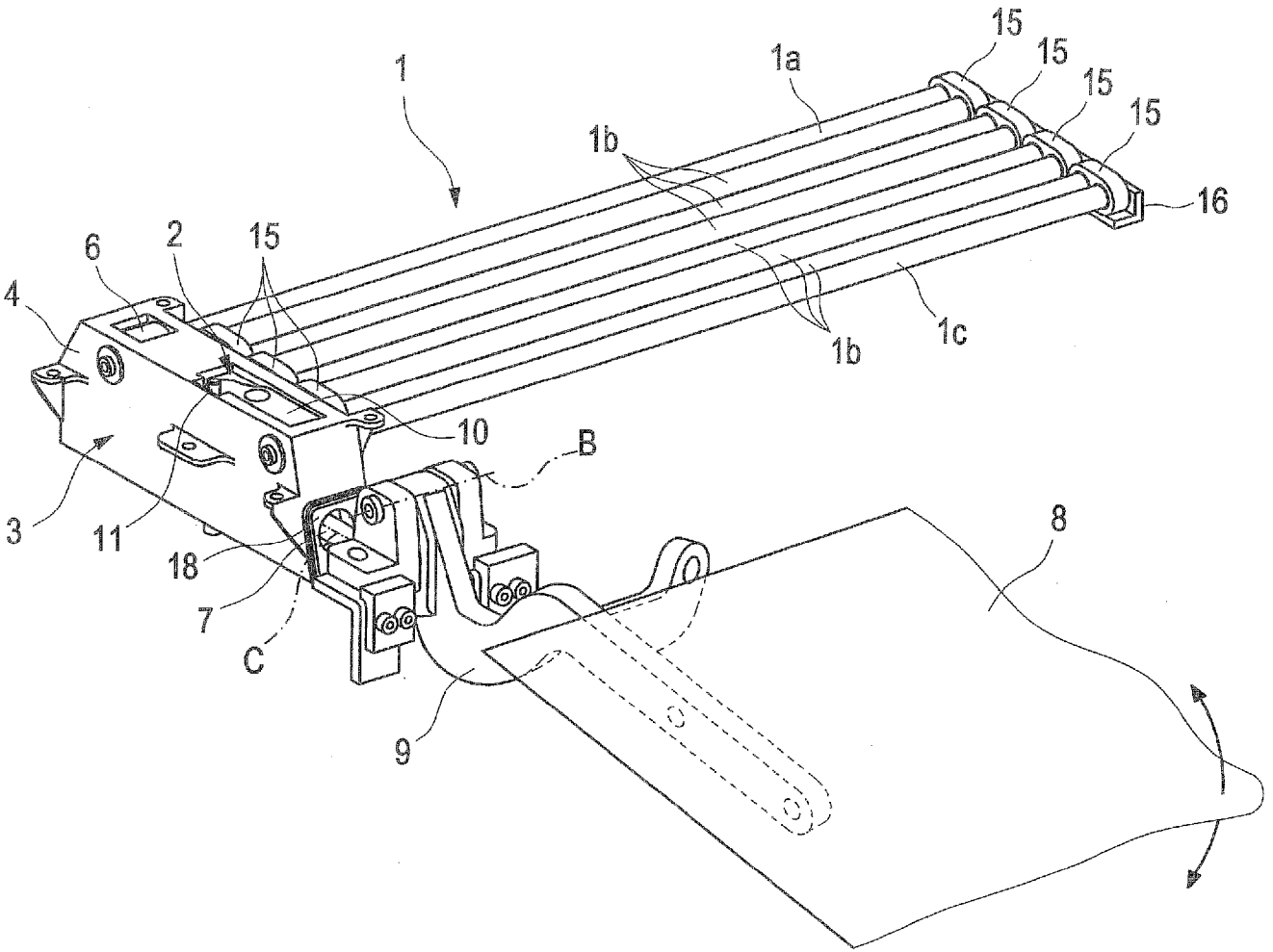
FIG. 2 shows an overall view of an apparatus according to the invention for spring-assisted pivoting of a liftgate or door.
Figure 3:
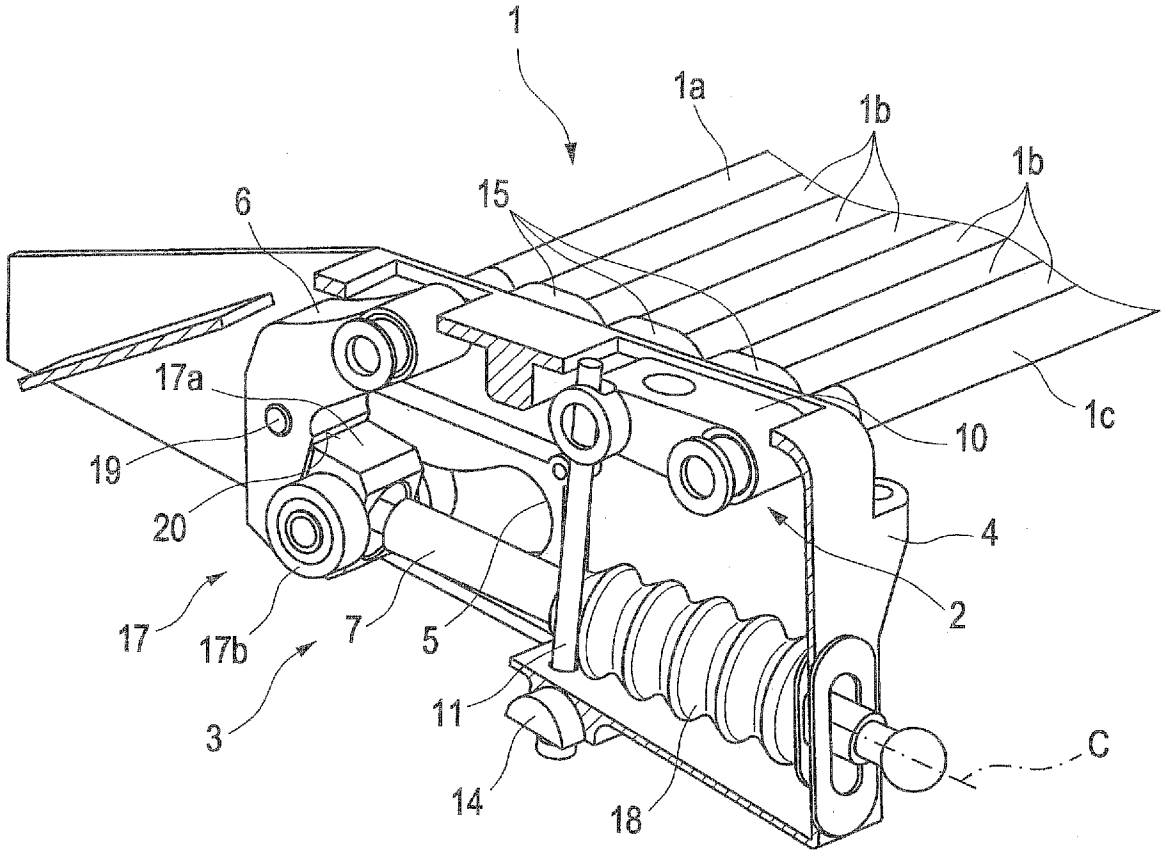
FIG. 3 shows a view of a first embodiment of an adjusting device for an apparatus according to the invention.
Figure 4:
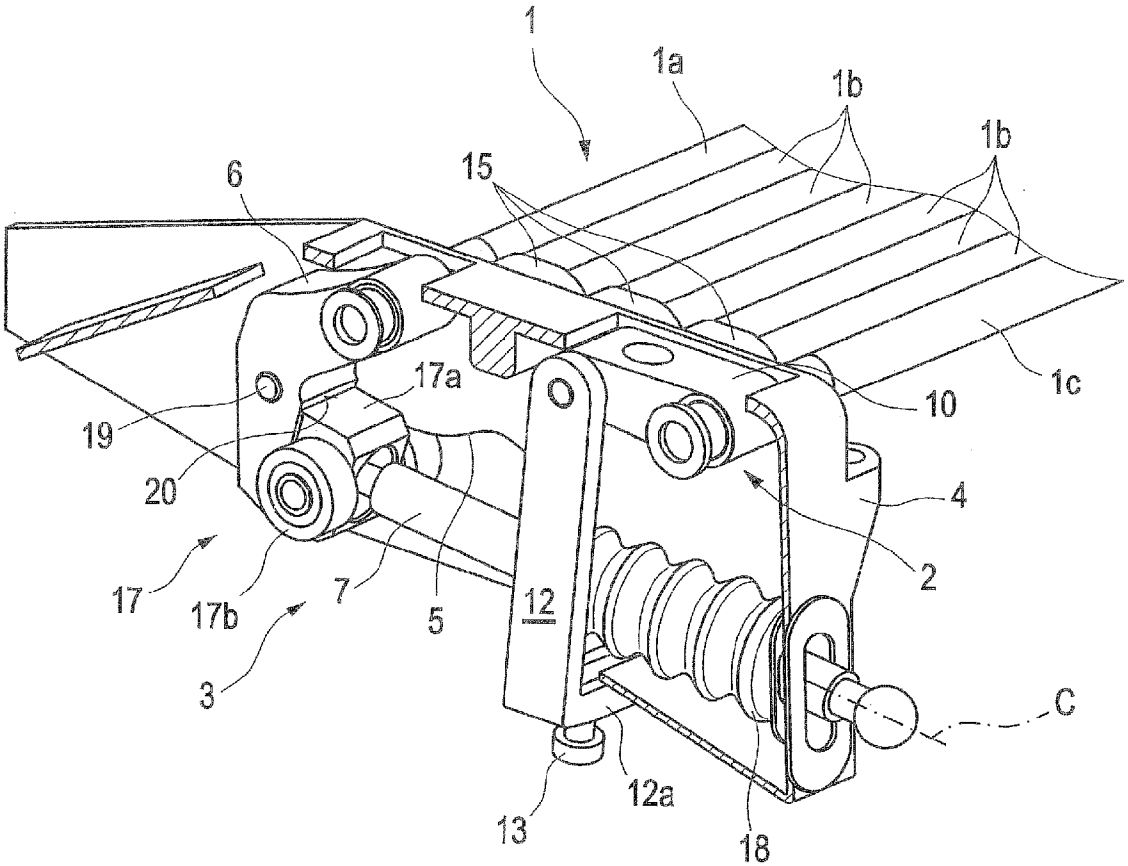
FIG. 4 shows a view of a second embodiment of an adjusting device for an apparatus according to the invention.

FIG. 2 shows an apparatus according to the invention for spring-assisted pivoting of a liftgate or door 8 of a type that is suitable for installation in a vehicle. Preferably, two symmetrically constructed apparatuses are installed in a roof region of the vehicle so as to each be capable of engaging on an upper marginal region of the liftgate or door 8. Each torsion bar spring system 1 of the two apparatuses preferably protrudes into the roof region to half the width of the vehicle body, so that two of the illustrated apparatuses can be arranged next to one another. The apparatus is essentially composed of a torsion bar spring system 1, as already illustrated in FIG. 1, a tracker 3 with the adjusting device 2 for pivoting a liftgate or door 8 attached to a pivotable hinged lever 9. The tracker 3 has a support bracket 4 which functions as a housing for the tracker 3. The lever-torsion bar spring la and the bearing-torsion bar spring 1*c* project into the support bracket 4 where they are supported for rotation. One end of a length-adjustable lever 6, which is arranged inside the support bracket 4, is attached in fixed rotative engagement on the lever-torsion bar spring 1*a*. The other end of the length-adjustable lever has, as illustrated in FIGS. 3 and 4, a slider arrangement 17 which is guided in a control cam 5 of the support bracket 4. The slider arrangement 17 is composed of a slider 17*a*, which is supported for longitudinal displacement on a slide track 20 of the length-adjustable lever 6, and a cam roller 17*b* which is rotatably received by the slider 17*a*. The cam roller 17*b* is guided in the control cam 5 almost without play, so that the cam roller 17*b* follows the contour of the control cam 5 and moves the slider 17*a* along the slide track 20. The movability of the slider 17*a* can alternatively also be attained with a slot or by elastically supporting the slider 17*a* on or in the length-adjustable lever 6. A coupling rod 7 engages on one end on the slider 17*a*, wherein the coupling rod 7 sealingly exits the support bracket 4 through a sealing collar 18; the opposite end is connected with the hinged lever 9. The longitudinal axis C of the coupling rod 7 does not intersect with the rotation axis B of the hinged lever 9, so that the translatory movement of the coupling rod 7 transitions into a rotation of the hinged lever 9, which causes the liftgate or door 8 associated with the hinged lever 9 to pivot, and vice versa. The opening through which the coupling rod 7 exits the support bracket 4 may be sealed by a sealing collar 18. An adjusting device 2 constructed in a manner illustrated in FIGS. 3 and 4 engages on the bearing-torsion bar spring 1*c*. The adjusting device 2 is used to fine-adjust the pretension of the torsion bar spring system 1 before and during the assembly of the apparatus and/or the installation of the apparatus in the vehicle. In a preferred embodiment, the lock of the adjusting device 2 after assembly or installation of the device can be temporarily canceled, allowing readjustment of the pretension of the torsion bar spring system for maintenance purposes. In the present illustration, the adjusting device 2 has an adjusting the lever 10, wherein one end is connected with the bearing-torsion rod spring 1*c* in fixed rotative engagement and the other end engages with an adjusting screw 11 which is supported against the support bracket 4. Rotation of the adjusting screw 11 causes the adjusting lever 10 to pivot which in turn changes the torsion of the connected torsion bar springs 1*a*, 1*b* and 1*c*. The torsion bar spring system 1 has a parallel end meander-shaped arrangement of torsion bar springs 1*a*, 1*b* and 1*c* which are connected with one another at the ends in fixed rotative engagement by way of elongated coupling elements 15. The torsion bar spring system 1 is pretensioned and the coupling elements 15 are preferably in a horizontal position, when the liftgate or door 8 is pivoted halfway between the closed position and the open position, thus covering in both directions the same rotation angle as defined by the torsion of the torsion bar springs 1*a*, 1*b* and 1*c*. The torsion bar spring system 1 is supported for improved stability in a bearing web 16 by way of the coupling elements 15 on the side facing the tracker 3, for example by rotatably coupling the coupling elements 15 with the bearing web 16 using centrally located pins. The linear torque provided by the torsion bar spring system 1 at the lever-torsion bar spring 1*a* and resulting from its pretension is converted by the kinematics arranged in the tracker 3 so as to produce on the hinged lever 9 a matched torque in form of a counter-torque opposing the torque of the liftgate or door 8 depending on the pivoting path of the liftgate or door 8. The operating forces of the liftgate or door 8 can thereby be significantly reduced, up to a self-locking of the liftgate or door 8 in any position along the pivoting path.

FIG. 3 and FIG. 4 each show a tracker 3 with attached torsion bar spring system 1 and different adjusting devices 2. Both embodiments have in common the torsion bar spring system 1 illustrated in FIG. 1, composed of several torsion bar springs 1*a*, 1*b* and 1*c* arranged in parallel in a meander pattern, which are connected with one another in fixed rotative engagement at the ends using coupling elements 15. The outer lever-torsion bar spring 1*a* and the bearing-torsion bar spring 1*c* are longer on one side of the torsion bar spring system 1 than the inner torsion bar springs 1*b*, allowing them to protrude into the support bracket 4 which forms the housing of the tracker 3. The lever-torsion bar spring 1 a is connected with one end of a length-adjustable lever 6, wherein the other end of the lever 6 has a slider arrangement 17. The slider arrangement 17 consists of a slider 17*a*, which is arranged for longitudinal movement on a slide path 20 of the length-adjustable lever 6, and two cam rollers 17*b* which are arranged on both sides on pins of the slider 17*a* and guided in corresponding control cams 5 with almost no play. The orientation of the slide path 20 follows essentially the physically effective lever arm of the length-adjustable lever 6 which need not necessarily correspond to the physical lever arm. For example, the length-adjustable lever 6 can have also elbowed or angled lever shapes in addition to straight lever shapes. The control cam 5 is either machined into the wall of the support bracket 4 (FIG. 4) or installed in the support bracket 4 as an additional module to facilitate interchange (FIG. 3). Moreover, a coupling rod 7 engages on the slider 17*a* which exits the tracker 3 through an opening in the support bracket 4. The opening can be sealed with a sealing collar 18. The length-adjustable lever 6 can be temporarily locked with respect to the support bracket 4 with a safety pin 19, as may be required, for example, during transport of the assembled device.

The adjusting device 2 in FIG. 3 includes an adjusting lever 10 having one end arranged in fixed rotative engagement on the bearing-torsion bar spring 1*c* and a second end with a thread for receiving an adjusting screw 11. The adjusting screw 11 extends through an opening in the bottom side of the support bracket 4. At this location, a V-shaped wedge 14 is arranged between the screw head and the support bracket 4 in a semi-circular opening of the support bracket 4, thereby providing a two-dimensional contact of the V-shaped wedge 14 on the support bracket 4, independent of the instantaneous position of the adjusting lever 10.

The adjusting device 2 in FIG. 4 includes an adjusting lever 10 having one end arranged in fixed rotative engagement on the bearing-torsion bar spring 1*c* and a second end rotatably connected with a tensioning bracket 12. The tensioning bracket 12 has an angled part 12*a* extending below the bottom side of the support bracket 4. The angled part 12*a* also has a thread with an adjusting screw 13 which is supported on the support bracket 4.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An apparatus for spring-assisted pivoting of a liftgate or door against gravity between a closed position and an open position, comprising:

a tracker comprising a support bracket and a control cam;

a length-adjustable lever guided in the control cam of the tracker;

a coupling rod configured for translatory movement and operatively connected to the length-adjustable lever, said coupling rod configured to rotationally move a hinged lever associated with the liftgate or door;

a torsion bar spring system having torsion bar springs arranged in parallel in a meander pattern and connected with one another in fixed rotative engagement;

wherein a first outer torsion bar spring of the torsion bar spring system is constructed as a bearing-torsion bar spring and a second outer torsion bar spring of the torsion bar spring system is constructed as a lever-torsion bar spring which is connected in fixed rotative engagement with the length-adjustable lever, with both the first and the second outer torsion bar spring being supported in the support bracket of the tracker; and an adjusting device connected in fixed rotative engagement with the bearing-torsion bar spring and variably lockable relative to the support bracket.

2. The apparatus of claim 1, wherein the adjusting device comprises an adjusting lever having two ends, with a first end at least temporarily in fixed rotative engagement with the bearing-torsion bar spring.

3. The apparatus of claim 2, wherein the adjusting lever has on a second end an adjusting screw which is supported on the support bracket.

4. The apparatus of claim 2, wherein the adjusting lever has on a second end a rotatable tensioning bracket having an angled part engaging below the support bracket at a variable distance.

5. The apparatus of claim 4, further comprising an adjusting screw arranged in the angled part, wherein the adjusting screw is supported on a bottom side of the support bracket such that an adjustment of the adjusting screw causes a change of the variable distance of the angled part from the bottom side of the support bracket.

6. A method for producing an apparatus for spring-assisted pivoting of a liftgate or door against gravity between a closed position and an open position, comprising the following steps:

Connecting torsion bar springs of a torsion bar spring system with coupling elements in fixed rotative engagement, twisting inner torsion bars of a torsion bar spring system until a first partial torque is attained when the torsion bar spring system is arranged in a plane;

Inserting an outer lever-torsion rod spring and an outer bearing-torsion bar spring of the torsion bar spring system in corresponding bearing seats of a support bracket;

Connecting the lever-torsion rod spring with a length-adjustable lever in fixed rotative engagement, pivoting the length-adjustable lever until a second partial torque of the torsion bar spring system is attained, and temporarily locking the length-adjustable lever with respect to the support bracket; and Connecting the bearing-torsion rod spring with an adjusting device, pivoting the adjusting device until a desired total torque of the torsion bar spring system is attained, and locking the adjusting device or the bearing-torsion bar spring.

7. The method of claim 6, further comprising the step of formfittingly or materially connecting the torsion bar springs with the coupling elements so that the coupling elements facing a tracker are pivotally supported in a bearing web.

8. The method of claim 6, wherein the coupling elements have an elongated shape and are oriented horizontally at an opening angle halfway between the closed position and the open position of the liftgate or door.

9. The method of claim 6, wherein the length-adjustable lever is formfittingly or materially connected with the lever-torsion bar spring and configured to be temporarily locked with respect to the support bracket with a safety pin.

10. The method of claim 6, wherein the adjusting device is materially connected with the support bracket.

* * * * *